US005307007A

United States Patent [19]

Wu et al.

[11] Patent Number: 5,307,007

[45] Date of Patent: Apr. 26, 1994

[54] CMOS BANDGAP VOLTAGE AND CURRENT REFERENCES

[75] Inventors: Chung-Yu Wu, Hsinchu; Shu-Yuan Chin, Tao-Yuan, both of Taiwan

[73] Assignee: National Science Council, Taipei, Taiwan

[21] Appl. No.: 963,093

[22] Filed: Oct. 19, 1992

[51] Int. Cl.[5] ..... G05F 3/16

[52] U.S. Cl. ..... 323/313; 323/315

[58] Field of Search ..... 323/312, 313, 314, 315, 323/907

[56] References Cited

U.S. PATENT DOCUMENTS

| | | | |
|---|---|---|---|
| 4,450,367 | 5/1984 | Whatley | 323/315 |
| 4,461,991 | 7/1984 | Smith | 323/312 |
| 4,792,750 | 12/1988 | Yan | 323/315 |
| 4,890,052 | 12/1989 | Hellums | 323/312 |
| 4,935,690 | 6/1990 | Yan | 323/907 |
| 5,038,053 | 8/1991 | Djenguerian et al. | 323/315 |
| 5,045,773 | 9/1991 | Westwick et al. | 323/315 |
| 5,144,223 | 9/1992 | Gillingham | 323/313 |

*Primary Examiner*—J. L. Sterrett
*Attorney, Agent, or Firm*—Ladas & Parry

[57] ABSTRACT

Precise CMOS bandgap voltage and current references which uses the difference of MOS source-gate voltages to perform efficient curvature compensation are proposed and analyzed. Applying the developed design strategies, bandgap voltage references (BVR) with a temperature drift below 10 ppm/°C. and a power supply drift below 10 ppm/V can be realized. For bandgap current references, both drifts can be under 15 ppm. An experimental BVR chip shows an average drift of 5.5 ppm/°C. from −60° C. to 150° C. and 25 μV/V for supply voltages between 5 V and 15 V at 25° C. Due to novel curvature compensation, the circuit structure of the proposed references is simple and both chip area and power consumption are small.

6 Claims, 9 Drawing Sheets

CMOS BANDGAP VOLTAGE AND CURRENT REFERENCES

BACKGROUND OF THE INVENTION

The present invention relates to CMOS bandgap voltage reference (BVR) devices and CMOS bandgap current reference (BCR) devices, particularly to provide stable voltage references and current references independent of power supply voltage and temperature.

Stable voltage and current references are essential in many electronic systems. The required performance of voltage and current references can be critical, especially in sensor/transducer systems and data converters. Generally, the ability to integrate an entire data acquisition or sensor/transducer system within a single CMOS VLSI chip is dependent upon being able to realize a CMOS compatible voltage or current reference with very low temperature drift and power supply voltage sensitivity. So far many techniques have been proposed to develop power-supply and temperature independent references.

Among them, the bandgap reference technique has shown the most potential. The principle of bandgap reference was first proposed by Widlar (refer to R. J. Wildar, "New developments in IC voltage regulators", IEEE J. Solid-state Circuits, vol. SC-6, pp. 2–7, Feb. 1979) and has been widely employed to implement stable voltage references in bipolar technology.

In CMOS technology, high-precision bandgap references using parasitic vertical bipolar transistors have recently been proposed (refer to B. S. Song and P. R. Gray, "A precision curvature-compensated CMOS bandgap reference", IEEE J. Solid-State Circuits, vol. SC-18, pp. 634–643, Dec. 1983; J. Michejda and S. K. Kim, "A precision CMOS bandgap reference", IEEE J. Solid-state Circuits,, vol. SC-19, pp. 1014–1021, Dec. 1984; M. G. R. Degrauwe et al. "CMOS voltage references using lateral bipolar transistors", IEEE J. Solid-state Circuits, vol. SC-20, pp. 1151–1157, Dec. 1985; and S. L. Lin and C. A. T. Salama, "A Vbe(T) model with application to bandgap reference design", IEEE J. Solid-state Circuits, vol. SC-20, pp. 1283–1285, Dec. 1985), which demonstrate a temperature drift below 40 ppm/°C.

However, the proposed references either suffer from high offset and drift of CMOS operational amplifiers or have very complex structures. Besides, the power supply voltage sensitivity is not low enough.

SUMMARY OF THE INVENTION

It is an object of the present invention to provide CMOS bandgap voltage reference (BVR) devices and CMOS bandgap current reference (BCR) devices.

It is another object of the present invention to provide stable voltage references and current references independent of power supply voltage and temperature.

It is still another object of the present invention to provide stable voltage references and current references with smaller chip area and less power consumption.

In accordance with the object of the present invention, a high temperature stability bandgap voltage reference (BVR) with an efficient curvature compensation technique is provided and can be made by standard CMOS processes. A pair of parasitic bipolar transistors is coupled with an appropriate resistor and back-to-back stacked PMOS and NMOS current mirrors to produce a temperature dependent current. This current is then mirrored to pass through an appropriate resistor to produced temperature coefficients that are equal in value but opposite in polarity to the temperature coefficients of the base to emitter difference voltage of a bipolar transistors to yield the desired stable reference voltage with below 10 ppm/°C. temperature drift. A capacitor in this circuit is used to start up this circuit. Furthermore, the proposed bandgap voltage reference (BVR) can be reconfigured into another structure,, where all the current mirrors are of the cascoded structures, and this modified structure can improve power supply voltage sensitivity significantly.

A precision bandgap current reference (BCR) is proposed based on the theory of bandgap voltage reference (BVR) mentioned above. Similarly, a cascode structure bandgap current reference is proposed to improve the power supply sensitivity significantly.

In addition, another bandgap voltage reference (BVR) slightly different from the proposed bandgap voltage reference (BVR) is also suggested.

BRIEF DESCRIPTION OF THE DRAWINGS

The present invention can be more fully understood by reference to the following description and accompanying drawings, wherein.

DETAILED DESCRIPTION OF THE PREFERRED EMBODIMENTS

Circuit Analysis and Operation Principle

A. Bandgap Voltage Reference (BVR)

Embodiment 1

Figure 1:
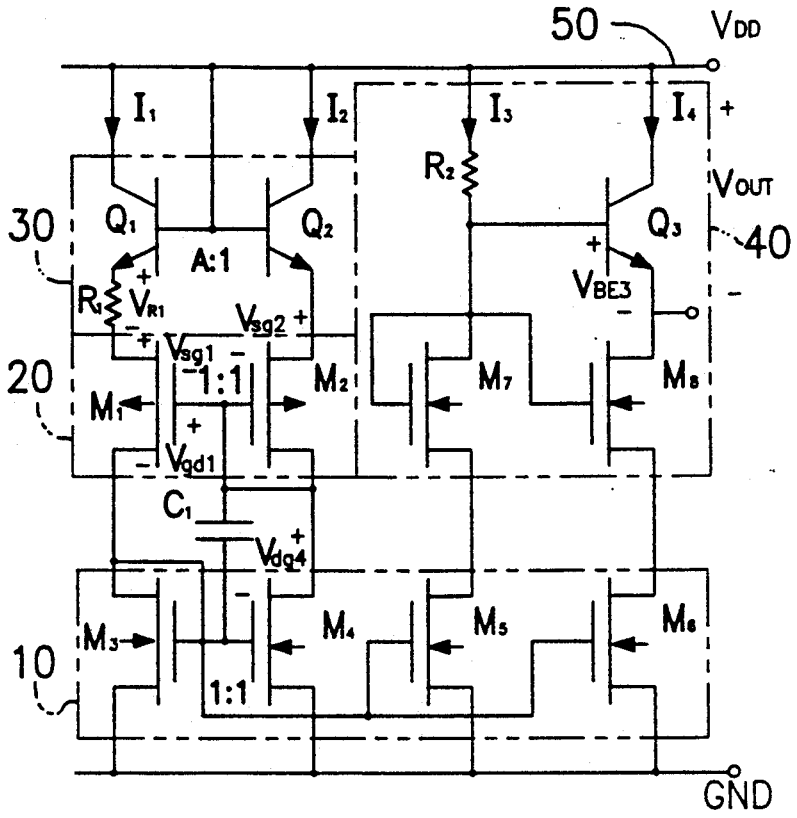
FIG. 1 depicts a circuit structure of a first embodiment, i.e. a circuit structure of a bandgap voltage reference (BVR)

Referring to FIG. 1, there is shown a circuit structure of a bandgap voltage reference (BVR), which is named as the Type A structure. The Type A structure comprises a first current mirror 10, a second current mirror 20, a current regulator 30, a voltage output regulator 40, a power supply 50 and a capacitor $C_1$, wherein the first current mirror 10 consists of four NMOS transistors $M_3$, $M_4$, $M_5$, and $M_6$; the second current mirror 20 consists of two PMOS transistors $M_1$ and $M_2$; the current regulator 30 is a PTAT (proportional to absolute temperature) current source which consists of two transistors $Q_1$, $Q_2$ and a resistor $R_1$; and the voltage output regulator 40 consists of two NMOS transistors $M_7$, $M_8$, a transistor $Q_3$ and a resistor $R_2$.

The four NMOS transistors $M_3$, $M_4$, $M_5$, and $M_6$ form the first current mirror 10 with the slave transistors $M_4$, $M_5$, and $M_6$. This first current mirror 10 forces the current $I_1$ to be approximately equal to $I_2$, $I_3$, and $I_4$, i.e. $I_1 \approx I_2 \approx I_3 \approx I_4$. The two PMOS transistors $M_1$ and $M_2$ are connected as the second current mirror 20 and inversely stacked on the $M_3$ and $M_4$ of the first current mirror 10. $M_1$, $M_2$, $M_3$ and $M_4$ form a stable current source independent of the voltage source change. Since the stacked current mirror structure has two stable current states, appropriate start-up circuitry must be included in the BVRs to ensure normal operation in the nonzero-current state. A simple start-up method is proposed, which requires only a capacitor $C_1$ connected between the gates of $M_2$ and $M_4$ as shown in FIG. 1. This start-up method is not only simple, but works well with different power supplies. The parasitic npn bipolar transistors $Q_1$ and $Q_2$ have an emitter area ratio of A. The transistors $Q_1$ and $Q_2$ and the resistor $R_1$ provide the PTAT (proportional to absolute temperature) current $I_1$.

The following is a description of the operation of the Type A structure in FIG. 1.

Consider the current path of $I_2$, the transistors $Q_2$, $M_2$, $M_4$ are initially turned off before power on. The voltage across $C_1$ is initially zero. Since $Q_2$ and $M_2$ are connected like diodes, the gate voltage of $M_2$ can be pulled high after power on. This voltage transient can generate a current through $C_1$ and this current can charge up the gate voltage of $M_4$. Finally, $M_4$ can be turned on. As long as $M_4$ is turned on, this circuit is started up and all the nodes voltages and currents will be forced to their normal values in the stable state.

Assume that the base-emitter voltage of the bipolar transistor is $V_{BE}$ and the source-gate voltage of the PMOS is $V_{sg}$. The voltage across $R_1$ can be written as $$\begin{aligned} V_{R1} &= V_{BE2} - V_{BE1} + (V_{sg2} - V_{sg1}) \\ &= \frac{kT}{q}\ln\left(A\frac{I_2}{I_1}\right) + (V_{sg2} - V_{sg1}) \\ &= \frac{kT}{q}\ln A^* + \Delta V_{sg} \end{aligned} \tag{1}$$

where $A^*$ is equal to $A(I_2/I_1)$, k is the Boltzmann's constant, T is the absolute temperature, and q is the electronic charge. If the actual ratio of the currents $I_3$ to $I_1$ is denoted as $r_3$, the output voltage of this reference circuit in FIG. 1 can be written as $$\begin{aligned} V_{out} &= V_{BE3} + I_3R_2 \\ &= V_{BE3} + r_3\frac{R_2}{R_1}\left(\frac{kT}{q}\ln A^* + \Delta V_{sg}\right) \end{aligned} \tag{2}$$

The term $\Delta V_{sg}$ in (2) can be further expressed in terms of device and circuit parameters. Consider the drain current $I_1$ and $I_2$ of the transistors $M_1$, $M_2$, $M_3$, $M_4$. They can be written as $$\begin{aligned} I_1 &= \frac{\mu_p C_o}{2}\left(\frac{W}{L}\right)_1 (V_{sg1} + V_{tp})^2 (1 + \lambda_p V_{sd1}) \\ &= \frac{\mu_n C_o}{2}\left(\frac{W}{L}\right)_3 (V_{gs3} - V_{tn})^2 (1 + \lambda_n V_{ds3}) \end{aligned} \tag{3}$$

$$\begin{aligned} I_2 &= \frac{\mu_p C_o}{2}\left(\frac{W}{L}\right)_2 (V_{sg2} + V_{tp})^2 (1 + \lambda_p V_{sd2}) \\ &= \frac{\mu_n C_o}{2}\left(\frac{W}{L}\right)_4 (V_{gs4} - V_{tn})^2 (1 + \lambda_n V_{ds4}) \end{aligned} \tag{4}$$

where $\mu$ is the surface mobility, $C_o$ is the channel oxide capacitance per unit area, W(L) is the channel width (length), $V_t$ is the MOS threshold voltage, and $\lambda$ is the factor of the equivalent Early effect. Employing (3) and (4) and assuming that $(W/L)_3 = (W/L)_4$, we can obtain $$V_{sg1} + V_{tp} = \left[\frac{2I_1}{\mu_p C_o (W/L)_1 (1 + \lambda_p V_{sd1})}\right]^{\frac{1}{2}} \tag{5}$$

$$V_{sg2} + V_{tp} = \left[\frac{2I_1 (1 + \lambda_n V_{ds4})}{\mu_p C_o (W/L)_2 (1 + \lambda_p V_{sd2})(1 + \lambda_n V_{ds3})}\right]^{\frac{1}{2}} \tag{6}$$

Since $(W/L)_1 = (W/L)_2$ and the channel lengths of the transistor $M_1$, $M_2$, $M_3$, $M_4$ are quite long, we have $$\lambda_p V_{sd1} << 1, \lambda_p V_{sd2} << 1, \lambda_n V_{ds3} << 1, \lambda_n V_{ds4} << 1$$

Under the above condition, $\Delta V_{sg}$ can be found from (5), (6) and (1) as $$\Delta V_{sg} = V_{sg2} - V_{sg1} \approx [\lambda_n(V_{ds4} - V_{ds3}) +$$

-continued $$\lambda_p(Vsd_1 - Vsd_2)]\left[2\left(\frac{W}{L}\right)_1 \mu_p C_o R_1\right]^{\frac{1}{2}}\left(\frac{kT}{q}\ln A^* + \Delta Vsg\right)^{\frac{1}{2}}$$

Since $\Delta Vsg << (kT/q)\ln A^*$, $\Delta Vsg$ can be further approximated as $$\Delta Vsg \approx K_1\left[\frac{T}{\mu_p R_1}\right]^{\frac{1}{2}} \quad (7)$$

where $$K_1 = [\lambda_n(Vds_4 - Vds_3) + \lambda_p(Vsd_1 - Vsd_2)]\left[\frac{k}{q}\ \frac{\ln A^*}{2C_o}\left(\frac{L}{W}\right)_1\right]^{\frac{1}{2}} \quad (8)$$

For pure Si materials near room temperature, the mobility varies as $T^{-2.42}$ and $T^{-2.2}$ for n- and p-type Si, respectively (refer to S.M. Sze: Physics of semiconductor devices, 2nd edition, pp. 29, 1981, by John Wiley & Sons, Inc.). For standard N+ polysilicon, the resistance varies a $T^{0.1}$ (refer to M. G. R. Degrauwe et al. "CMOS voltage references using lateral bipolar transistors", IEEE J. Solid-state Circuits, vol. SC-20, pp. 1151–1157, Dec. 1985). Thus $\mu_p$ and $R_1$ can be expressed as $$\mu_p = \mu_o T^{-2\text{-}2} \quad (9)$$

$$R_1 = R_o T^{0\text{-}1} \quad (10)$$

where $\mu_o$ and $R_o$ are temperature independent constants. Substituting (9) and (10) into (7), $\Delta V_{sg}$ can be rewritten as $$\Delta Vsg \approx K_2 T^{1\text{-}55} \quad (11)$$

where $$K_2 = K_1(\mu_o R_o)^{\frac{1}{2}} \quad (12)$$

The temperature coefficients of $\Delta V_{sg}$ at $T_o$ can be expressed as $$b_0 = \Delta Vsg|_{T=T_o} \approx K_2 T_o^{1.55} \quad (13)$$

$$b_1 = \frac{d\Delta Vsg}{dT}\Big|_{T=T_o} \approx 1.55\ K_2 T_o^{0.55} \quad (14)$$

$$b_2 = \frac{d^2\Delta Vsg}{dT^2}\Big|_{T=T_o} \approx 0.85\ K_2 T_o^{-0.45} \quad (15)$$

It can be seen that all the coefficients are positive.

The base-emitter voltage $V_{BE3}$ in (2) can be modeled as $$V_{BE3} = \frac{kT}{q}\ln(I_4/I_s) \approx \frac{kT}{q}\ln\left[\left(r_4\frac{kT}{q}\ln A^*\right)/I_s R_1\right] \quad (16)$$

where $\nabla V_{sg} << (kT)/(q)\ \ln A^*$ is assumed, $r_4 \equiv (I_4)/(I_1)$ is nearly independent of temperature, and $I_s$ is the reverse saturation current of the bipolar transistor $Q_4$. Using the temperature relations in (9) and (10), $V_{BE3}$ in (16) can be rewritten as $$V_{BE3} = V_{Go} - 0.9\frac{kT}{q}\ln K_3 - 0.9\frac{kT}{q}\ln T \quad (17)$$

where $V_{Go}$ is the energy gap of silicon and $K_3$ is a temperature independent constant. The temperature coefficients of the last term in (17) at $T_o$ can be derived $$a_0 = 0.9\frac{kT}{q}\ln T_o \quad (18)$$

$$a_1 = 0.9\frac{k}{q}\ln T_o + 0.9\frac{k}{q} \quad (19)$$

$$a_2 = 0.9\frac{k}{q}\ \frac{1}{T_o} \quad (20)$$

where $a_o$, $a_1$, $a_2$ are all positive.

Using (13)–(15) and (17)–(20), (2) can be expressed as $$V_{out} \approx V_{Go} + \frac{kT}{q}\left(r_3\frac{R_2}{R_1}\ln A^* - 0.9\ln K_3\right) + \left(r_3\frac{R_2}{R_1}b_0 - a_0\right) + \left(r_3\frac{R_2}{R_1}b_1 - a_1\right)(T - T_o)\left(r_3\frac{R_2}{R_1}b_2 - a_2\right)(T - T_o)^2 \quad (21)$$

It can be seen that the curvature compensation can be achieved through the coefficients $b_2$ of $\Delta V_{sg}$ and the stable ratio of $R_2/R_1$. Thus a high-stability BVR is expected.

As shown in FIG. 1, the stacked current-mirror are formed with the MOS transistors $M_2$ and $M_3$ connected like diodes. Since $V_{gd1} = V_{dg4} > 0$, $I_2$ is slightly larger than $I_1$ due to the equivalent Early effect. The smaller $I_1$ flows through the PMOS $M_1$ with its drain-source voltage $V_{ds}$ greater than that in $M_2$ which carries the larger current I2. This makes the source-gate voltages $V_{sg2} > V_{sg1}$ and produces a positive $\Delta V_{sg}$. Thus curvature compensation can be achieved as in (21) and a precision temperature stable output voltage can be obtained.

Embodiment 2

Figure 2:
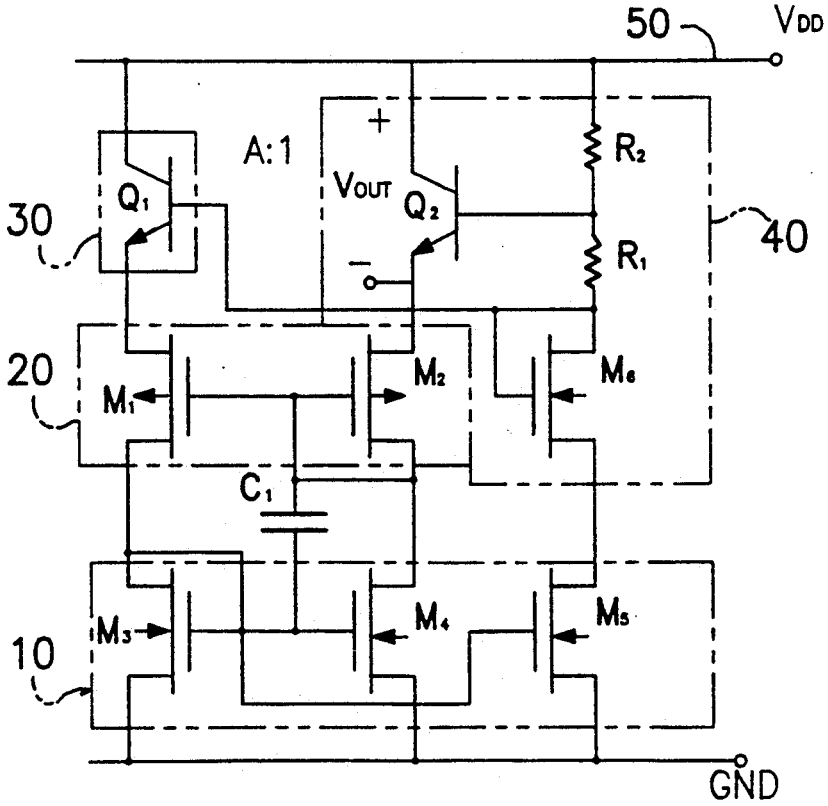
FIG. 2 depicts a circuit structure of a second embodiment, i.e. a circuit structure of the simplified bandgap voltage reference (BVR) in FIG. 1.

The Type A structure can be simplified to Type B structure, as shown in FIG. 2. The Type B structure comprises a first current mirror 10, a second current mirror 20, a current regulator 30, a voltage output regulator 40, a power supply 50 and a capacitor $C_1$. The circuit structure of the Type B is quite similar to the Type A but with less elements. The type B contains only two n-p-n transistors, six MOS transistors, and one start-up capacitor. It occupies a smaller chip area and exhibits lower power dissipation than the Type A structure, but otherwise, its performance is nearly the same.

Embodiment 3

Figure 3:
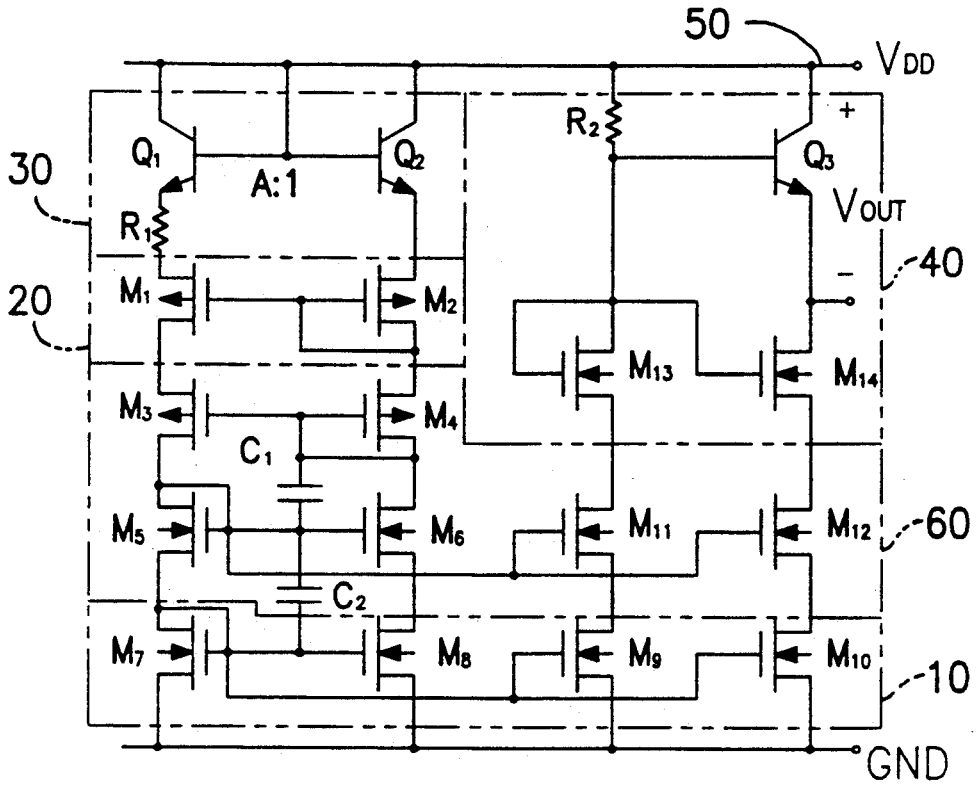
FIG. 3 depicts a circuit structure of a third embodiment, i.e. a circuit structure of a cascode-structure BVR.

Base on the same principle, another structure called the Type C is formed as shown in FIG. 3, the circuit structure of the Type C is the same as the Type A except for a cascoded circuit 60. All the current mirrors of the Type C have cascoded structures. Although this structure uses more devices than the Types A and B, it can improve power supply sensitivity significantly.

Because the MOS transistors are cascoded, a higher supply voltage than those in the Types A and B is required to ensure that all MOS transistors work in the saturation region.

B. Bandgap Current Reference (BCR)

Embodiment 4

Figure 4:
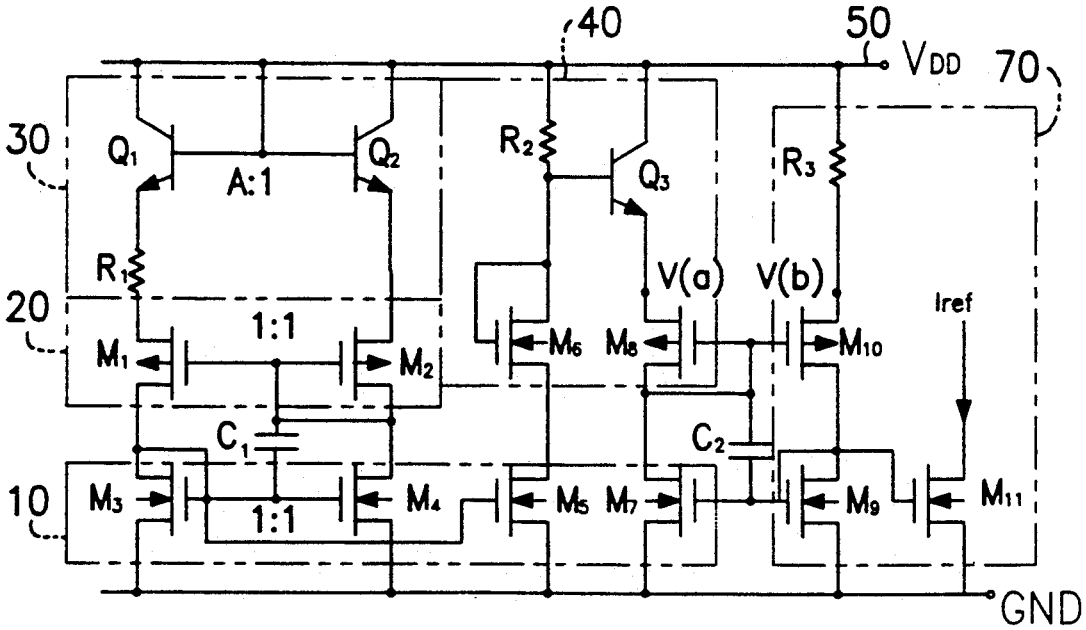
FIG. 4 depicts a circuit structure of a fourth embodiment, i.e. a circuit structure of a bandgap current reference (BCR)

Based on the theory of BVR (Bandgap Voltage Reference) mentioned above, a precision BCR (Bandgap Current Reference) is proposed and shown in FIG. 4. The circuit structure of the proposed BCR is quite similar to the Type A structure except for the voltage-current transfer circuit 70; the working theory of $Q_1$, $Q_2$, $R_1$, $R_2$, $Q_3$ and $M_1$–$M_8$ are about the same as the Type A structure, thus a stable voltage V(a) can be obtained. Because the ratio of the current mirror $M_7/M_9$ and $M_8/M_{10}$ is equal to 1, this means that $M_7$, $M_8$, $M_9$, $M_{10}$ form a stable current source (just as $M_1$, $M_2$, $M_3$, $M_4$ of the embodiment 1), thus V(a) and V(b) are approximately equal and V(b) can be written as $$\begin{aligned} V(b) &= V(a) + Vsg_8 - Vsg_{10} \\ &= V(a) + \Delta Vsg \end{aligned} \tag{22}$$

If the actual ratio of $I_{ref}$ to $I_3$ is denoted as r, the output reference current in FIG. 4 can be written as $$I_{ref} = -\frac{r}{R_3}[V(a) + \Delta Vsg] \tag{23}$$

According to the analysis in the previous subsection, $\Delta V_{sg} > 0$ and has positive first- and second-order temperature coefficients. Thus it can provide partial of compensation for the thermal effect of $R_3$. Similarly, through the control of $R_2/R_1$, V(a) can also have suitable first- and second-order temperature coefficients to compensate for the thermal effect of $R_3$. This means that the voltage of V(b) is designed to perform the first-order and the curvature compensations to $R_3$; thus, the resulting output current will demonstrate a small temperature drift.

Embodiment 5

Figure 5:
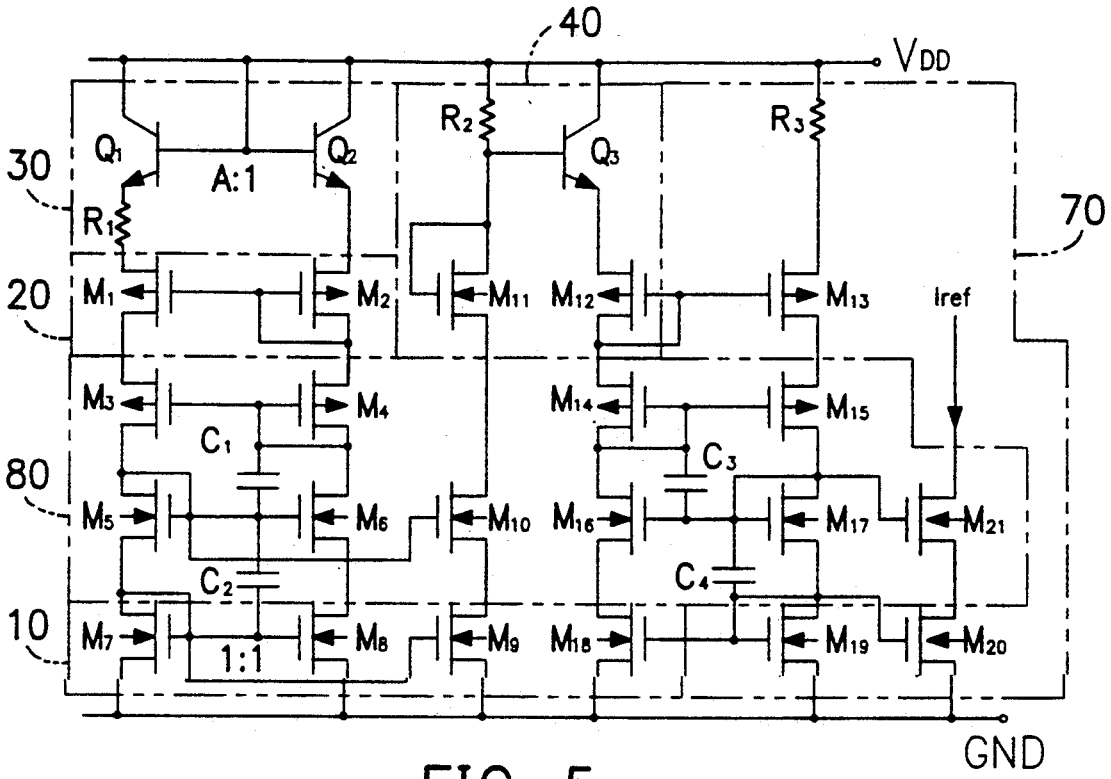
FIG. 5 depicts a circuit structure of a fifth embodiment, i.e. a circuit structure of a cascode-structure BCR.

FIG. 5 is a circuit structure of a cascode-structure BCR (Bandgap Current Reference), the circuit structure of FIG. 5 is similar to FIG. 4 except for a cascoded circuit 80. The cascoded circuit 80 includes $M_3$, $M_4$, $M_5$, $M_6$, $M_{10}$, $M_{14}$, $M_{15}$, $M_{16}$, $M_{17}$ and $M_{21}$. All the current mirrors of FIG. 5 have cascoded structures. Although this structure uses more devices than FIG. 4, it can improve power supply sensitivity significantly.

Design Strategies and Considerations

A. Current-Mirror Connection

Embodiment 6

Figure 6:
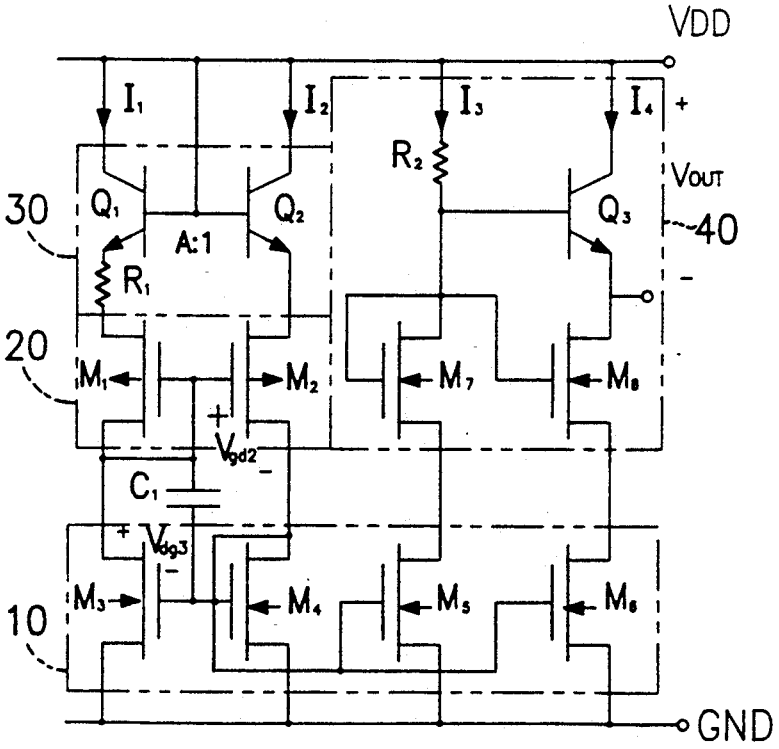
FIG. 6 depicts a circuit structure of a sixth embodiment, i.e. a circuit structure of the BVR in FIG. 1 with different current mirror connections.
Figure 7:
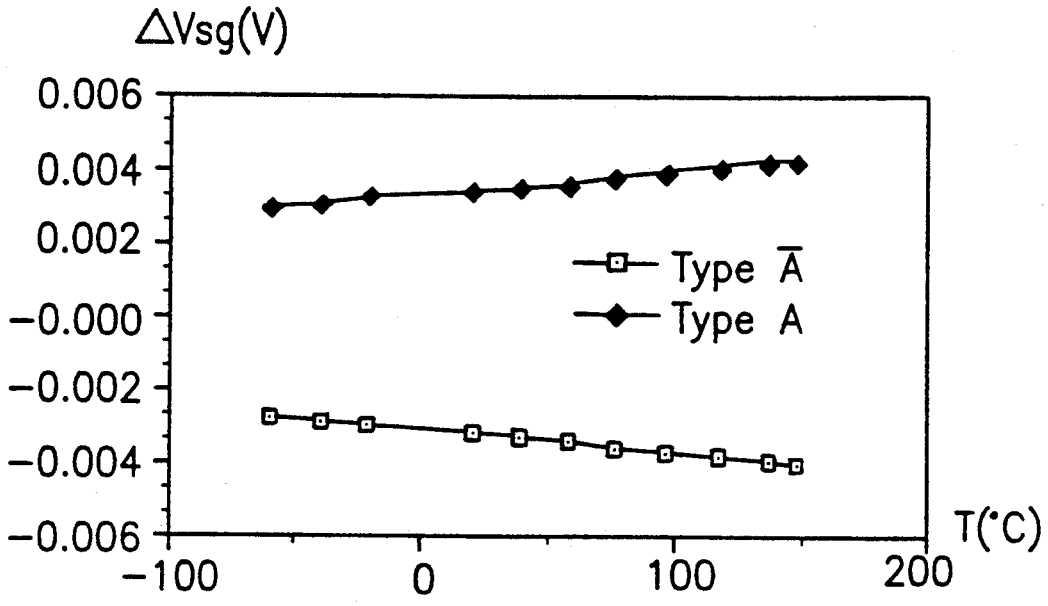
FIG. 7 depicts the variations of $\Delta V_{sg}$ versus temperature in both first embodiment and sixth embodiment.
Figure 8:
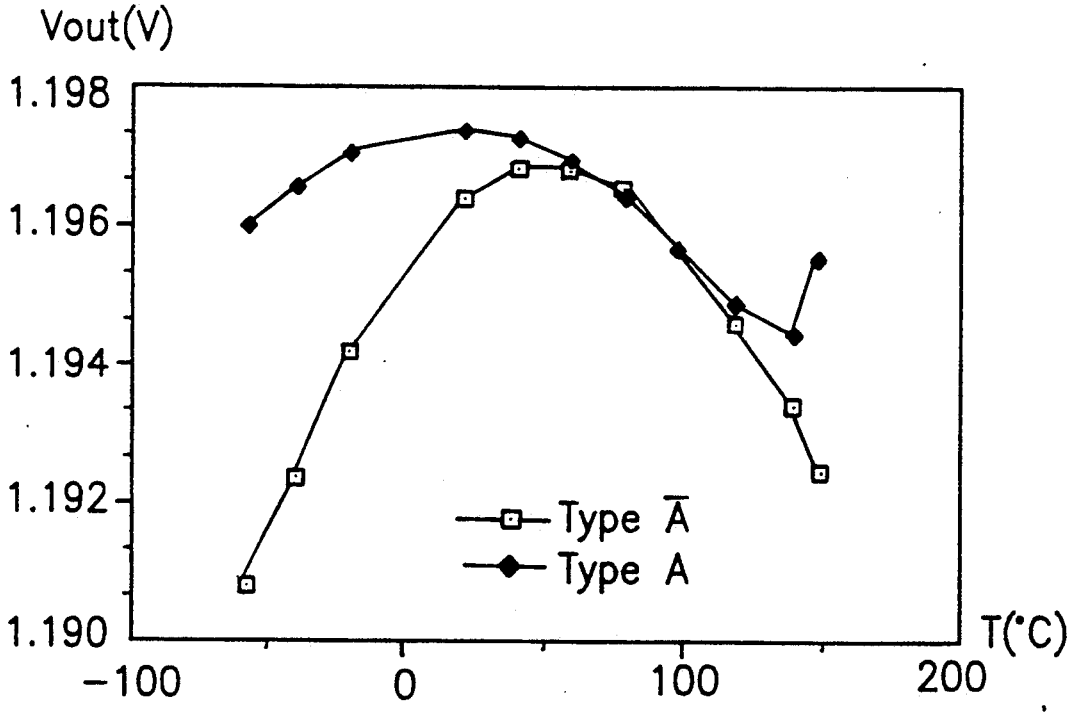
FIG. 8 depicts the simulated output voltages versus temperature in both first embodiment and sixth embodiment.

The circuit structure of Type $\overline{A}$ shown in FIG. 6, the only difference between FIG. 6 and FIG. 1 is that for FIG. 6, the gate and the drain of $M_1$ and $M_4$, rather than $M_2$ and $M_3$, are short-circuited. $V_{gd2} = V_{dg3} > 0$ leads to negative $\Delta V_{sg}$, $K_1$, $K_2$, $b_o$, $b_1$, and $b_2$. Thus, this structure can not achieve curvature compensation from (21). SPICE simulations of both Type A and Type $\overline{A}$ circuits have been done to verify the above analysis. FIG. 7 shows the variations of $\Delta V_{sg}$ versus temperature for both Type A and Type $\overline{A}$. It is seen that $\Delta V_{sg}$ of the Type A is positive and increases with temperature, while that of Type $\overline{A}$ is negative and decreases with temperature. FIG. 8 shows the output voltage of both types of circuits with respect to temperature. It can be seen that the voltage variations of the Type $\overline{A}$ is greater than those of the Type A, because the curvature compensation cannot be achieved by the negative $\Delta V_{sg}$ in the Type $\overline{A}$. This is consistent with the analysis.

B. Device Size Optimization

In generally, a large W/L ratio is necessary for MOS current mirrors to reduce mismatch error, to make the MOS transistors operate in the saturation region, and to obtain a low power supply sensitivity. In the present design, the W/L ratios are 12 and 25 for NMOS and PMOS devices respectively, at a 5 V power supply voltage. The emitter area ratio A has to be greater than 1 in normal operations. Nevertheless, the ratio cannot be too large, so that the total ship area required for the transistors and the resistor $R_1$ can be kept reasonable.

Figure 9:
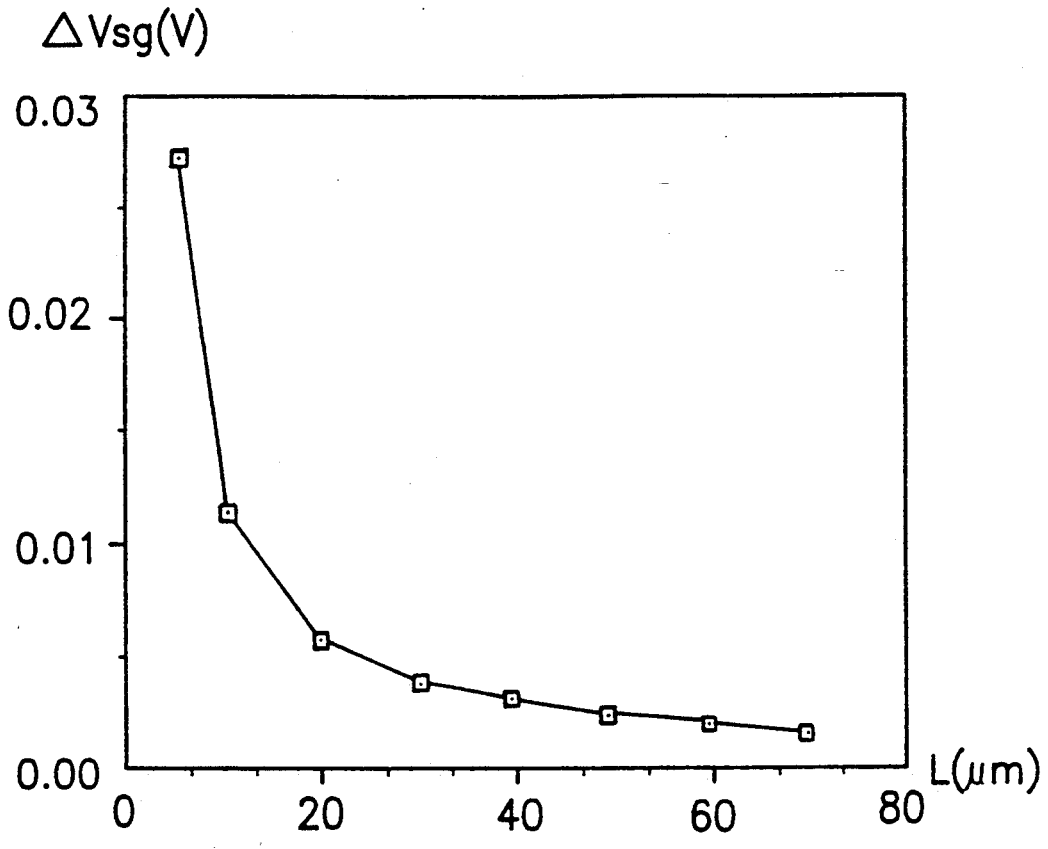
FIG. 9 depicts the variations of $\Delta V_{sg}$ versus MOS channel length in the first embodiment.
Figure 10:
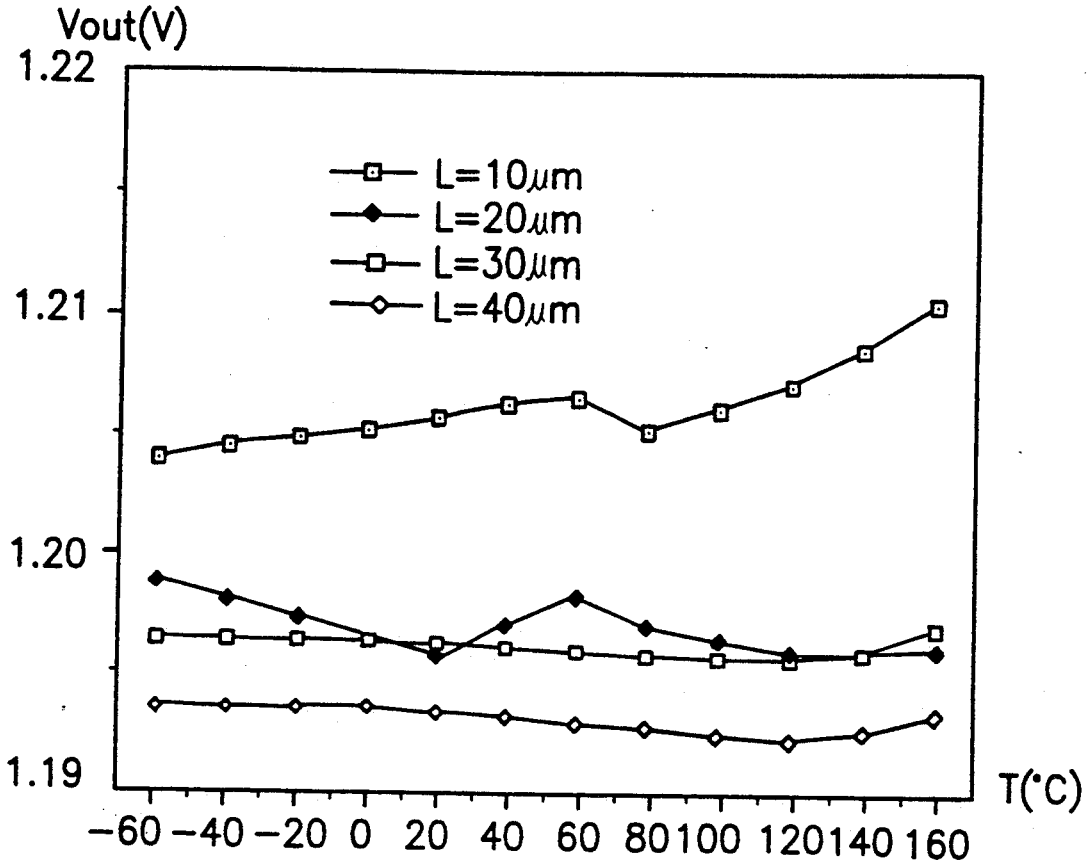
FIG. 10 depicts the optimized BVR output voltages versus MOS channel length in the first embodiment.

$\Delta V_{sg}$ is determined primarily by the equivalent Early effect which is dependent upon the MOS channel length. FIG. 9 shows the SPICE simulation results of $\Delta V_{sg}$ as a function of MOS channel length L for the Type A BVR under a constant 5 V power supply and with a constant W/L ratio. As it shows, the values of $\Delta V_{sg}$ decrease with the increase of channel length and tend to saturate when the channel length is longer than 30 μm. The simulation output voltages $V_{out}$ of BVRs as a function of temperature for different MOS channel lengths are shown in FIG. 10 where the power supply and the W/L ratio are fixed. It can be obviously seen that $V_{out}$ becomes very temperature stable for the channel length longer than 30 μm, whereas that for the channel length smaller than 20 μm has a larger variation due to improper curvature compensation. In the present design, we choose the channel length to be 30 gm for a 5 V power supply voltage. The higher the power supply is, the larger $V_{ds}$ and $V_{sg}$ will be. Thus, a longer channel length is required to obtained a smaller λ and maintain proper curvature compensation.

C. Start-up Capacitor Design

Since the stacked current mirror structure has two stable current states, appropriate start-up circuitry must be included in the BVRs to ensure the normal operation in the nonzero-current state. A simple start-up method is proposed, which requires only a capacitor $C_1$ connected between the gates of $M_2$ and $M_4$ as shown in FIG. 1. This start-up method is not only simple, but works well with different power supplies voltages.

Figure 11:
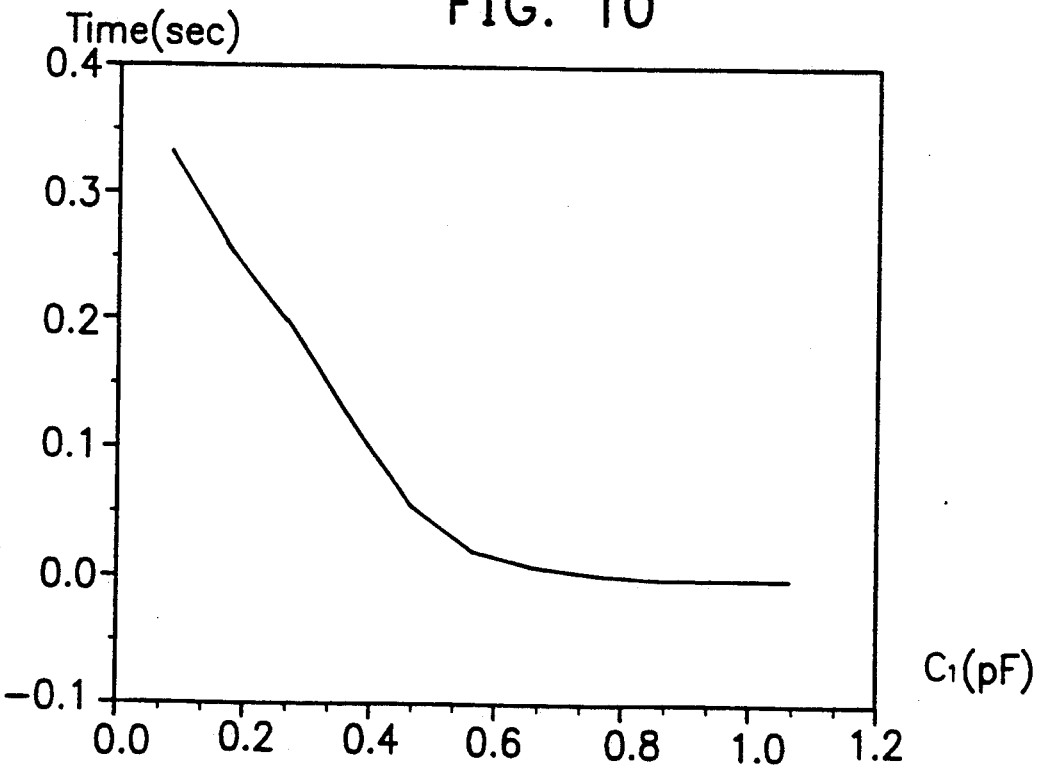
FIG. 11 depicts the variations of start-up speed versus $C_1$ in the first embodiment.

The SPICE simulated start-up speed under different $C_1$ in the Type A BVR are shown in FIG. 11. It can be seen that the larger $C_1$ is, the faster the start-up speed will be. Moreover, $C_1 = 0.6$ pF is enough for fast start-up. Thus, the required $C_1$ does not occupy a too large chip area. For lower power supply voltages, a larger $C_1$ is required.

Spice Simulation and Experimental Results

A. SPICE Simulation Results

Figure 12:
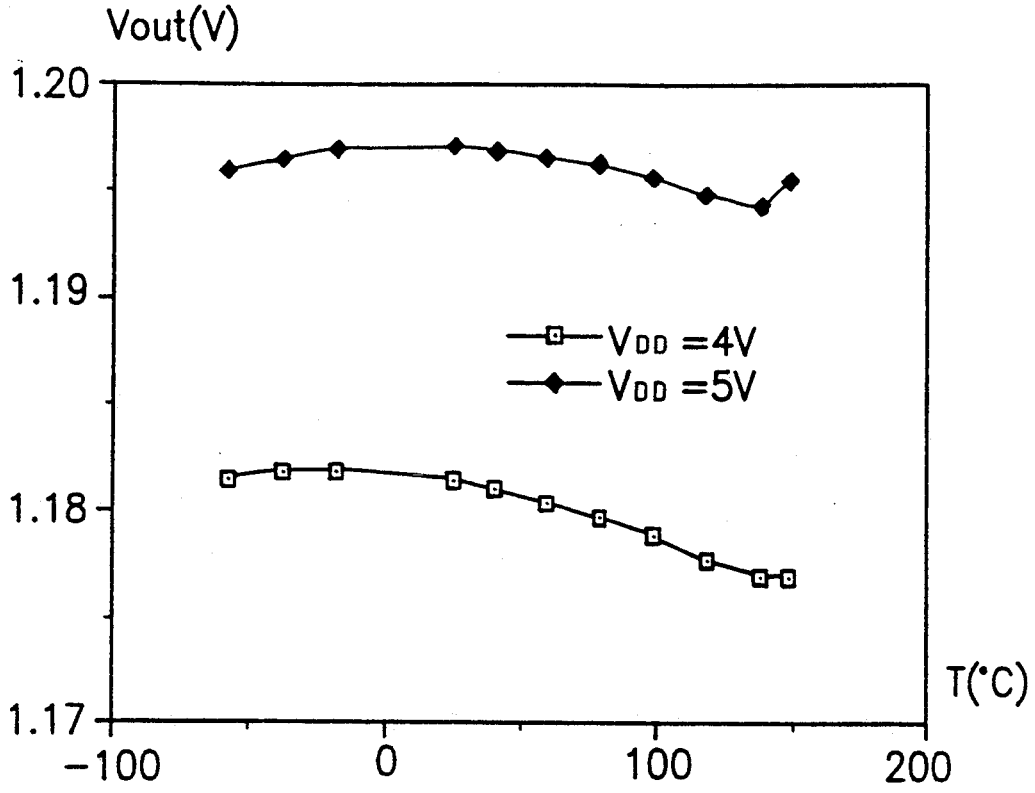
FIG. 12 depicts the SPICE simulation results of the output voltages of the first embodiment over the temperature range of −60° C. to 150° C. with different supply voltages.
Figure 13:
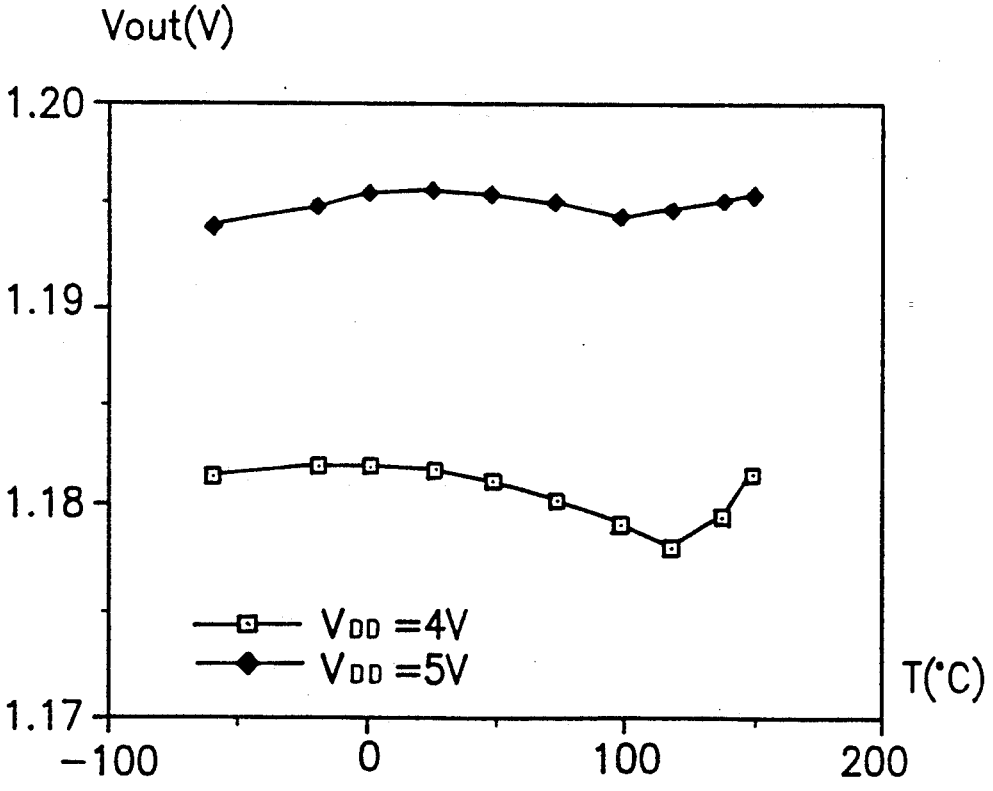
FIG. 13 depicts the SPICE simulation results of the output voltages of the second embodiment over the temperature range of −60° C. to 150° C. with different supply voltages.
Figure 14:
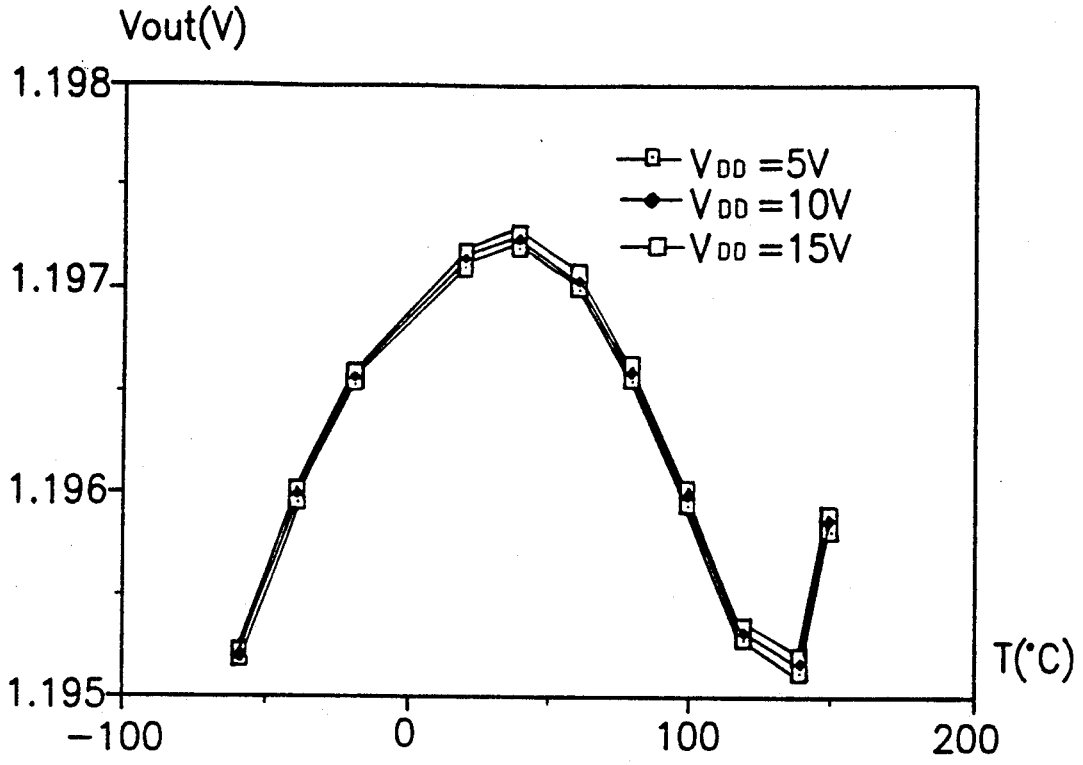
FIG. 14 depicts the SPICE simulation results of the output voltages of the third embodiment over the temperature rang of −60° C. to 150° C. with different supply voltages; supply voltages.

The SPICE simulation results of the output voltages of type A BVRs over the temperature range of −60° C. to 150° C. are shown in FIG. 12 where different supply voltages are used. This circuit has only 5.7 ppm/°C. temperature drift with a 5 v power supply. The similar simulation results of Type B BVRs are shown in FIG. 13. This circuit has only 7.2 ppm/°C. temperature drift with a 5 V power supply. As may seen from FIG. 12 and FIG. 13, both types are sensitive to power supply voltage variations. FIG. 14 shows the SPICE simulation results of the cascode-structure BVRS (Type C). The temperature drift is 8.6 ppm/°C. from −50° C. to 160° C. and the voltage drift is 7.1 ppm/V for power supply voltages between 5 V and 15 V. Thus, the cascode structure can provide the most stable output voltage over a large power supply voltage range. Nevertheless, its power supply voltage has to be higher than 4 V to ensure that all MOS transistors work in the saturation region.

Figure 15:
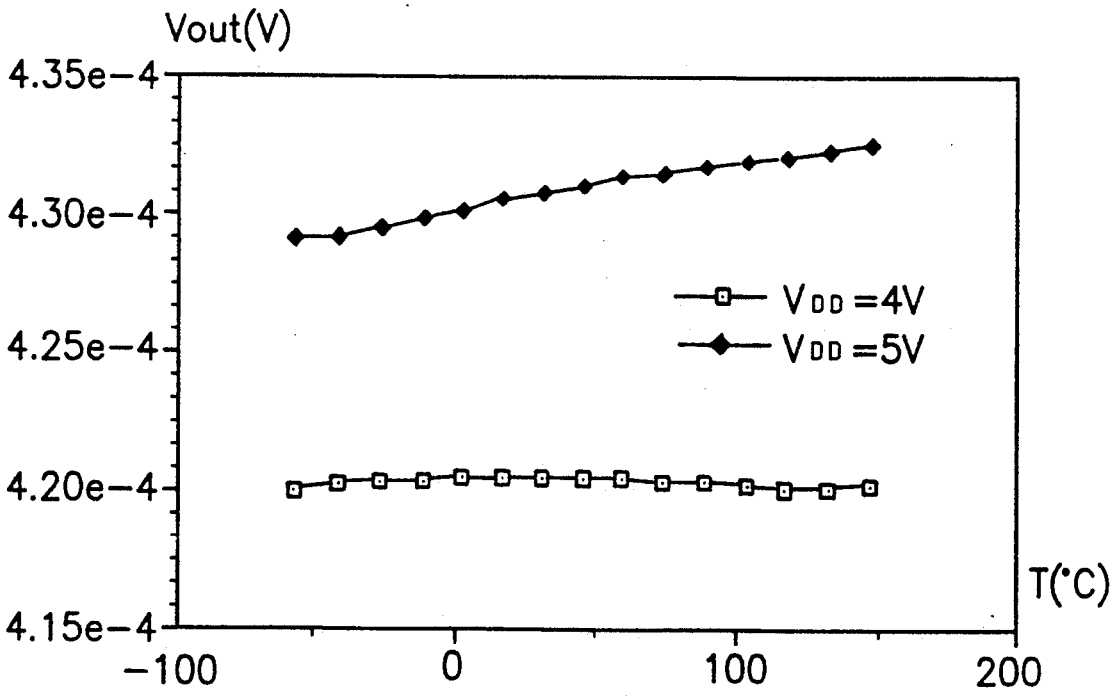
FIG. 15 depicts the SPICE simulation results of the output voltages of the fourth embodiment over the temperature range of −60° C. to 150° C. with different supply voltages.
Figure 16:
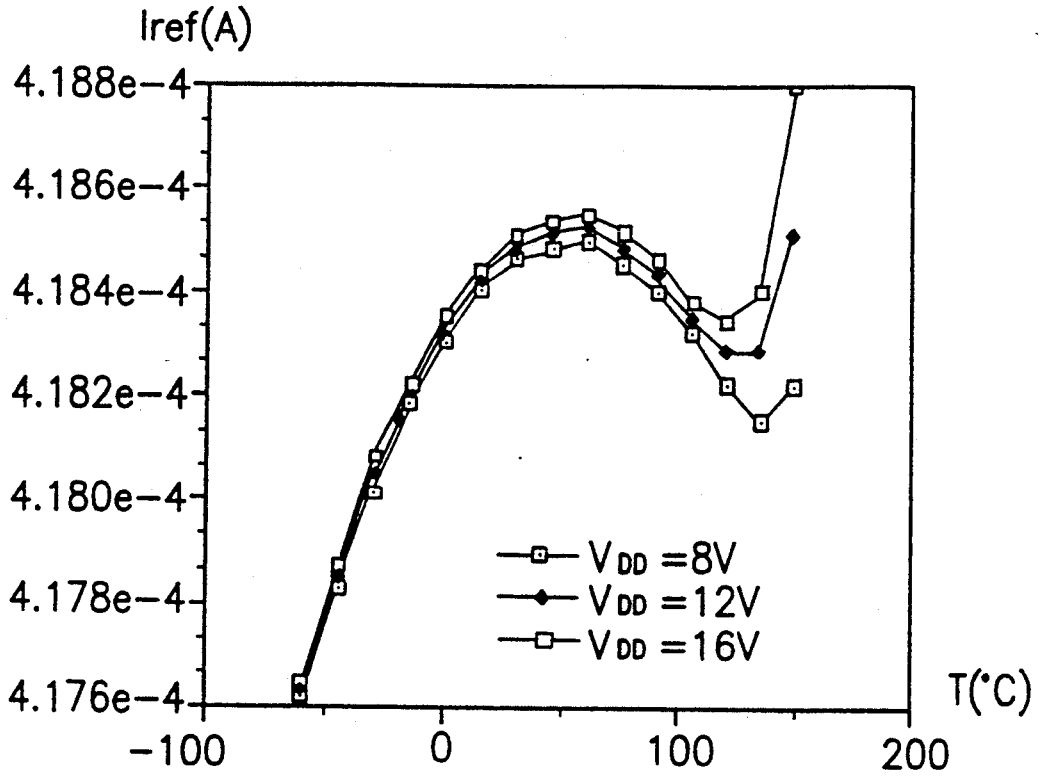
FIG. 16 depicts the SPICE simulation results of the output voltages of the fifth embodiment over the temperature range of −60° C. to 150° C. with different supply voltages.

The SPICE simulation results of the proposed BCR (FIG. 4) is shown in FIG. 15. The output current is 420 μA with a 5 V power supply and the temperature drift is only 11.6 ppm/°C. from −50° C. to 160° C. But this structure is sensitive to power supply voltage variations. FIG. 16 shows the simulation results of the cascode structure BCR. The output current is 418 μA, while the voltage drift is 15 ppm/V for power supply voltages between 8 V and 10 V, and the thermal drift is 10 ppm/°C. from −50° C. to 160° C.

B. Experimental Results

Figure 17:
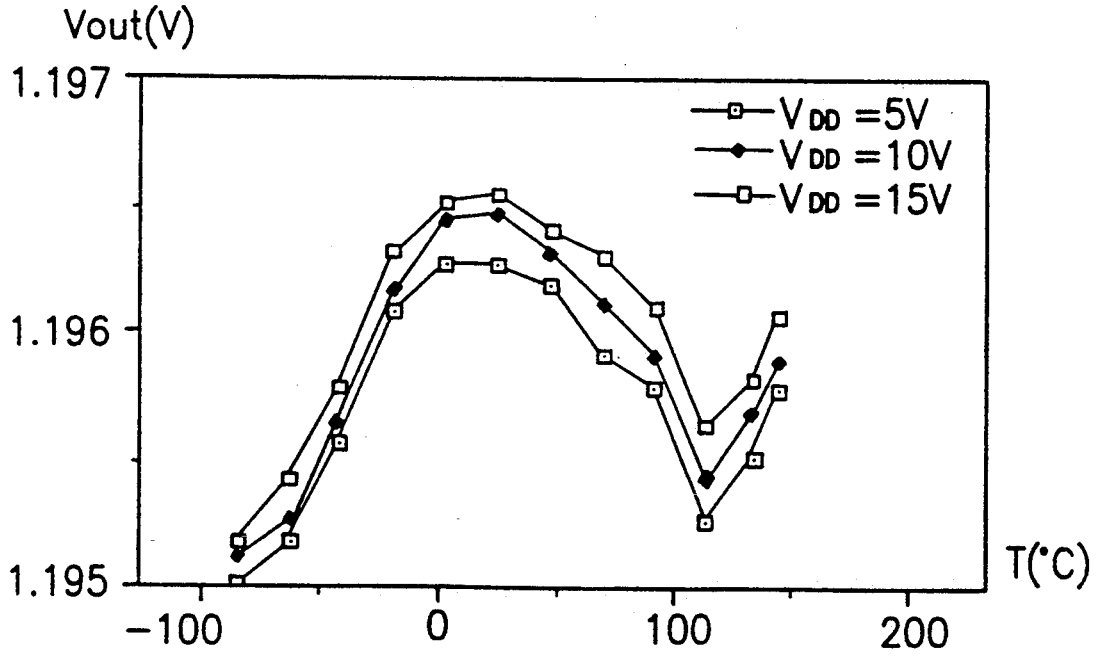
FIG. 17 depicts the measured output voltages versus temperature in the fabricated cascode structure BVR in FIG. 3.

To experimentally verify the performance of the proposed BVRS, the Type C BVR was designed and fabricated by using 3.5 μm p-well CMOS technology. For convenience, the resistors $R_1$ (1 KΩ) and $R_2$ (13.5 KΩ) are not realized on-chip. The measured performance of this experimental BVR chip is summarized in Table 1. The measured output voltage variations versus temperature under different power supply voltages are shown in FIG. 17. The average temperature drift is 5.5 ppm/°C. from −60° C. to 150° C. for power supply voltages from 5 V to 15 V. For power supply voltages from 5 V to 15 V at 25° C., the output voltage changes from 1.1963 V to 1.1965 V with an average drift of 25 μV/V. This circuit occupies 2 $mil^2$ and dissipates 0.8 mW at a power supply of 5 V.

CONCLUSION

A novel technique for curvature compensation is proposed which uses the difference of source-gate voltage to perform efficient curvature compensation. Base upon the new principle, bandgap voltage and current references have been designed, analyzed and experimentally verified. Design strategies and considerations have also been developed. Through proper design, the proposed BVRs and BCRs can have a very high temperature stability and a very low power supply sensitivity. Moreover, they have simple structure, small chip area, little power consumption, and complete CMOS compatibility. This makes these circuits quite applicable in high precision CMOS integrated systems.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

TABLE 1

The main performance of the fabricated cascode-structure BVR (Type C)

| Parameter | Typical values | Units |
|---|---|---|
| Output-voltage change (−60° C. to 150° C.) | 5.5 | ppm/°C. |
| supply current | 40 | μA |
| Output voltage | 1.196 | V |
| Supply voltage range | 5-15 | V |
| Power dissipation | 0.8 (at 5 V) | mW |
| PSRR | 94 | dB |

What is claimed is:

1. A CMOS bandgap voltage reference device for generating a reference voltage, comprising:

(1) a first bipolar transistor and a second bipolar transistor with different emitter areas having their collectors and bases connected together;

(2) a first resistor having one end connected to the emitter of said first bipolar transistor;

(3) a first MOS transistor having its source connected to another end of said first resistor;

(4) a second MOS transistor having its gate and drain shorted together, and its source connected to the emitter of said second bipolar transistor;

(5) a third MOS transistor having its gate and drain shorted together, and its drain connected to the drain of said first MOS transistor;

(6) a fourth MOS transistor having its drain connected to the drain of said second MOS transistor, its gate connected to the gate of said third MOS transistor, and its source connected to the source of said third MOS transistor;

(7) a fifth MOS transistor having its gate connected to the gate of said third MOS transistor, its source connected to the source of said third MOS transistor;

(8) a sixth MOS transistor having its gate connected to the gate of said third MOS transistor, its source connected to the source of said third MOS transistor;

(9) a seventh MOS transistor having its gate and drain shorted together, its source connected to the drain of said fifth MOS transistor;

(10) an eighth MOS transistor having its gate connected to the drain of said seventh MOS transistor, its source connected to the drain of said sixth MOS transistor;

(11) a second resistor connected between the collector of said second bipolar transistor and the drain of said seventh MOS transistor;

(12) a third bipolar transistor having its collector connected to the collector of said second bipolar transistor, its base connected to the drain of said seventh MOS transistor, its emitter connected to the drain of said eighth MOS transistor;

(13) a capacitor connected between the gate of said first MOS transistor and the gate of said third MOS transistor;

(14) means for connecting the collector of said third bipolar transistor and the positive terminal of an external voltage source;

(15) means for connecting the source of said sixth MOS transistor and the negative terminal of said external voltage source; and

(16) means for connecting the emitter of said third bipolar transistor and the drain of said eighth MOS transistor, so as to produce a voltage difference between the collector of said bipolar third transistor and the emitter of said third bipolar transistor.

2. A simplified CMOS bandgap voltage reference device for generating a reference voltage, comprising:

(1) a first bipolar transistor and a second bipolar transistor with different emitter areas having their collectors connected together;

(2) a first resistor connected between the base of said first bipolar transistor and the base of said second bipolar transistor;

(3) a second resistor connected between the base of said second bipolar transistor and the collector of said second bipolar transistor;

(4) a first MOS transistor having its source connected to the emitter of said first bipolar transistor;

(5) a second MOS transistor having its gate and drain shorted together and connected to the gate of said first MOS transistor, and its source connected to the emitter of said second bipolar transistor;

(6) a third MOS transistor having its gate and drain shorted together, and its drain connected to the drain of said first MOS transistor;

(7) a fourth MOS transistor having its drain connected to the drain of said second MOS transistor, its gate connected to the gate of said third MOS transistor, and its source connected to the source of said third MOS transistor;

(8) a fifth MOS transistor having its gate connected to the gate of said third MOS transistor, and its source connected to the source of said third MOS transistor;

(9) a sixth MOS transistor having its gate and drain shorted together, and connected to the base of said first bipolar transistor, and its source connected to the drain of said fifth MOS transistor;

(11) a capacitor connected between the gate of said first MOS transistor and the gate of said third MOS transistor;

(12) means for connecting the collector of said second bipolar transistor and the positive terminal of an external voltage source;

(13) means for connecting the source of said fifth MOS transistor and the negative terminal of said external voltage source; and

(14) means for connecting the emitter of said second bipolar transistor and the source of said second MOS transistor, so as to produce a voltage difference between the collector of said second bipolar transistor and the emitter of said second bipolar transistor.

3. A cascode-structure CMOS bandgap voltage reference device for generating a reference voltage, comprising:

(1) a first bipolar transistor and a second bipolar transistor with different emitter areas having their collectors and bases connected together;

(2) a first resistor having one end connected to the emitter of said first bipolar transistor;

(3) a first MOS transistor having its source connected to another end of said first resistor;

(4) a second MOS transistor having its gate and drain shorted together, and its source connected to the emitter of said second bipolar transistor;

(5) a third MOS transistor having its source connected to the drain of said first MOS transistor;

(6) a fourth MOS transistor having its gate and drain shorted together, and its source connected to the drain of said second bipolar transistor;

(7) a fifth MOS transistor having its gate and drain shorted together, and its drain connected to the drain of said third MOS transistor;

(8) a sixth MOS transistor having its drain connected to the drain of said fourth MOS transistor, and its gate connected to the gate of said fifth MOS transistor;

(9) a seventh MOS transistor having its gate and drain shorted together, and its drain connected to the source of said fifth MOS transistor;

(10) a eighth MOS transistor having its drain connected to the source of said sixth MOS transistor, its gate connected to the gate of said seventh MOS transistor, its source connected to the source of said seventh MOS transistor;

(11) a ninth MOS transistor having its gate connected to the gate of said seventh MOS transistor, and its source connected to the source of said seventh MOS transistor;

(12) a tenth MOS transistor having its gate connected to the gate of said seventh MOS transistor, and its source connected to the source of said seventh MOS transistor;

(13) a eleventh MOS transistor having its gate connected to the gate of said fifth MOS transistor, and its source connected to the drain of said ninth MOS transistor;

(14) a twelfth MOS transistor having its gate connected to the gate of said fifth MOS transistor, and its source connected to the drain of said tenth MOS transistor;

(15) a thirteenth MOS transistor having its gate and drain shorted together, and its source connected to the drain of said eleventh MOS transistor;

(16) a fourteenth MOS transistor having its gate connected to the drain of said thirteenth MOS transistor, and its source connected to the drain of said twelfth MOS transistor;

(17) a second resistor connected between the collector of said second bipolar transistor and the drain of said thirteenth MOS transistor

(18) a third bipolar transistor having its collector connected to the collector of said second bipolar transistor, its base connected to the drain of said thirteenth MOS transistor, and its emitter connected to the drain of said fourteenth MOS transistor;

(19) a first capacitor connected between the gate of said third MOS transistor and the gate of said fifth MOS transistor;

(20) a second capacitor connected between the gate of said fifth MOS transistor and the gate of said seventh MOS transistor;

(21) means for connecting the base of said third bipolar transistor and the positive terminal of an external voltage source;

(22) means for connecting the source of said tenth MOS transistor and the negative terminal of said external voltage source; and

(23) means for connecting the emitter of said third bipolar transistor and the drain of said fourteenth MOS transistor, so as to produce a voltage difference between the collector of said third bipolar transistor and the emitter of said third bipolar transistor.

4. A CMOS bandgap current reference for generating a reference current, comprising:

(1) a first bipolar transistor and a second bipolar transistor with different emitter areas having their collectors and bases connected together;
(2) a first resistor having one end connected to the emitter of said first bipolar transistor;
(3) a first MOS transistor having its source connected to another end of said first resistor;
(4) a second MOS transistor having its gate and drain shorted together, and its source connected to the emitter of said second bipolar transistor;
(5) a third MOS transistor having its gate and drain shorted together, and its drain connected to the drain of said first MOS transistor;
(6) a fourth MOS transistor having its drain connected to the drain of said second MOS transistor, its gate connected to the gate of said third MOS transistor, and its source connected to the source of said third MOS transistor;
(7) a fifth MOS transistor having its gate connected to the gate of said third MOS transistor, and its source connected to the source of said third MOS transistor;
(8) a sixth MOS transistor having its gate and drain shorted together, and its source connected to the drain of said fifth MOS transistor;
(9) a seventh MOS transistor having its source connected to the source of said third MOS transistor;
(10) an eighth MOS transistor having its gate and drain shorted together, and its drain connected to the drain of said seventh MOS transistor;
(11) a ninth MOS transistor having its gate and drain shorted together, and its source connected to the source of said third MOS transistor;
(12) a tenth MOS transistor having its gate connected to the gate of said eighth MOS transistor, its drain connected to the drain of said ninth MOS transistor;
(13) a eleventh MOS transistor having its gate connected to the drain of said ninth MOS transistor, and its source connected to the source of said third MOS transistor;
(14) a third bipolar transistor having its collector connected to the collector of said second bipolar transistor, its base connected to the drain of said sixth MOS transistor, and its emitter connected to the source of said eighth MOS transistor;
(15) a second resistor connected between the collector and the base of said third bipolar transistor;
(16) a third resistor connected between the collector of said third bipolar transistor and the source of said tenth MOS transistor;
(17) a first capacitor connected between the gate of said first MOS transistor and the gate of said third MOS transistor;
(18) a second capacitor connected between the gate of said eighth MOS transistor and the gate of said seventh MOS transistor;
(19) means for connecting the collector of said third bipolar transistor and the positive terminal of an external voltage source;
(20) means for connecting the source of said eleventh MOS transistor and the negative terminal of said external voltage source; and
(21) means for connecting the drain of said eleventh MOS transistor, so as to produce a current.

5. A cascode-structure CMOS bandgap current reference for generating a reference current, comprising:

(1) a first bipolar transistor and a second bipolar transistor with different emitter areas having their collectors and bases connected together;
(2) a first resistor having one end connected to the emitter of said first bipolar transistor;
(3) a first MOS transistor having its source connected to another end of said first resistor;
(4) a second MOS transistor having its gate and drain shorted together, and its source connected to the emitter of said second bipolar transistor;
(5) a third MOS transistor having its source connected to the drain of said first MOS transistor;
(6) a fourth MOS transistor having its gate and drain shorted together, and its source connected to the drain of said second bipolar transistor;
(7) a fifth MOS transistor having its gate and drain shorted together, and its drain connected to the drain of said third MOS transistor;
(8) a sixth MOS transistor having its drain connected to the drain of said fourth MOS transistor, and its gate connected to the gate of said fifth MOS transistor;
(9) a seventh MOS transistor having its gate and drain shorted together, and its drain connected to the source of said fifth MOS transistor;
(10) an eighth MOS transistor having its drain connected to the source of said sixth MOS transistor, its gate connected to the gate of said seventh MOS transistor, its source connected to the source of said seventh MOS transistor;
(11) a ninth MOS transistor having its gate connected to the gate of said seventh MOS transistor, and its source connected to the source of said seventh MOS transistor;
(12) a tenth MOS transistor having its gate connected to the gate of said fifth MOS transistor, and its source connected to the drain of said ninth MOS transistor;
(13) a eleventh MOS transistor having its gate and drain shorted together, and its source connected to the drain of said tenth MOS transistor;
(14) a third bipolar transistor having its base connected to the drain of said eleventh MOS transistor, its collector connected to the collector of said second bipolar transistor;
(15) a second resistor connected between the collector of said third bipolar transistor and the base of said third bipolar transistor;
(16) a twelfth MOS transistor having its gate and drain shorted together, and its source connected to the emitter of said third bipolar transistor;
(17) a thirteenth MOS transistor having its gate connected to the gate of said twelfth MOS transistor;
(18) a third resistor connected between the collector of said third bipolar transistor and the source of said thirteenth MOS transistor;
(19) a fourteenth MOS transistor having its gate and drain shorted together, and its source connected to the drain of said twelfth-MOS transistor;
(20) a fifteenth MOS transistor having its source connected to the drain of said thirteenth MOS transistor, its gate connected to the gate of said fourteenth MOS transistor;
(21) a sixteenth MOS transistor having its drain connected to the drain of said fourteenth MOS transistor;
(22) a seventeenth MOS transistor having its gate and drain shorted together, and its drain connected to the drain of said fifteenth MOS transistor, its gate connected to the gate of said sixteenth MOS transistor;

(23) an eighteenth MOS transistor having its drain connected to the source of said sixteenth MOS transistor, its source connected to the source of said seventh MOS transistor;

(24) a nineteenth MOS transistor having its gate and drain shorted together, and its drain connected to the source of said seventeenth MOS transistor, its source connected to the source of said seventh MOS transistor;

(25) a twentieth MOS transistor having its gate connected to the drain of said nineteenth MOS transistor, its source connected to the source of said seventh MOS transistor;

(26) a twenty first MOS transistor having its gate connected to the drain of said seventeenth MOS transistor, its source connected to the drain of said twentieth MOS transistor;

(27) a first capacitor connected between the gate of said third MOS transistor and the gate of said fifth MOS transistor;

(28) a second capacitor connected between the gate of said fifth MOS transistor and the gate of said seventh MOS transistor;

(29) a third capacitor connected between the gate of said fourteenth MOS transistor and the gate of said sixteenth MOS transistor;

(30) a fourth capacitor connected between the gate of said sixteenth MOS transistor and the gate of said eighteenth MOS transistor;

(31) means for connecting the collector of said third bipolar transistor and the positive terminal of an external voltage source;

(32) means for connecting the source of said twentieth MOS transistor and the negative terminal of said external voltage source; and

(33) means for connecting the drain of said twenty first MOS transistor, so as to produce a current.

6. A modified CMOS bandgap voltage reference device for generating a reference voltage, comprising:

(1) a first bipolar transistor and a second bipolar transistor with different emitter areas having their collectors and bases connected together;

(2) a first resistor having one end connected to the emitter of said first bipolar transistor;

(3) a first MOS transistor having its source connected to another end of said first resistor, its gate and drain shorted together;

(4) a second MOS transistor having its source connected to the emitter of said second bipolar transistor, its gate connected to the gate of said first MOS transistor;

(5) a third MOS transistor having its drain connected to the drain of said first MOS transistor;

(6) a fourth MOS transistor having its gate and drain shorted together, its drain connected to the drain of said second MOS transistor, its gate connected to the gate of said third MOS transistor, and its source connected to the source of said third MOS transistor;

(7) a fifth MOS transistor having its gate connected to the gate of said third MOS transistor, its source connected to the source of said third MOS transistor;

(8) a sixth MOS transistor having its gate connected to the gate of said third MOS transistor, its source connected to the source of said third MOS transistor;

(9) a seventh MOS transistor having its gate and drain shorted together, its source connected to the drain of said fifth MOS transistor;

(10) an eighth MOS transistor having its gate connected to the drain of said seventh MOS transistor, its source connected to the drain of said sixth MOS transistor;

(11) a second resistor connected between the collector of said second bipolar transistor and the drain of said seventh MOS transistor;

(12) a third bipolar transistor having its collector connected to the collector of said second bipolar transistor, its base connected to the drain of said seventh MOS transistor, its emitter connected to the drain of said eighth MOS transistor;

(13) a capacitor connected between the gate of said first MOS transistor and the gate of said third MOS transistor;

(14) means for connecting the collector of said third bipolar transistor and the positive terminal of an external voltage source;

(15) means for connecting the source of said sixth MOS transistor and the negative terminal of said external voltage source; and

(16) means for connecting the emitter of said third bipolar transistor and the drain of said eighth MOS transistor, so as to produce a voltage difference between the collector of said bipolar third transistor and the emitter of said third bipolar transistor.

* * * * *